US005621987A

United States Patent [19]

Pratt et al.

[11] Patent Number: 5,621,987

[45] Date of Patent: Apr. 22, 1997

[54] IMPLEMENT COUPLING ASSEMBLY FOR EXCAVATOR MACHINES AND THE LIKE

[75] Inventors: Samuel S. Pratt, Bedford; Dan Shaffer, Duncansville; Tim A. Davis, Berlin; Ashley Heiple, Alum Bank, all of Pa.

[73] Assignee: Rockland, Inc., Bedford, Pa.

[21] Appl. No.: 482,414

[22] Filed: Jun. 8, 1995

[51] Int. Cl.[6] ..... E02F 3/96

[52] U.S. Cl. ..... 37/468; 37/403; 414/723; 172/272; 403/322

[58] Field of Search ..... 37/468, 379, 403; 414/723, 722; 403/321, 322, 24, 381, 374; 172/272–275

[56] References Cited

U.S. PATENT DOCUMENTS

| | | | |
|---|---|---|---|
| 3,141,250 | 7/1964 | Eddins | 172/780 |
| 3,356,325 | 12/1967 | Schnase | 403/322 X |
| 3,923,407 | 12/1975 | Jensen et al. | 403/322 X |
| 4,663,866 | 5/1987 | Karlsson et al. | 37/468 X |
| 4,838,725 | 6/1989 | Fazis | 403/322 |
| 4,944,628 | 7/1990 | Hulden | 37/468 X |
| 5,222,826 | 6/1993 | Hanke | 403/322 X |
| 5,333,400 | 8/1994 | Sonerud | 37/468 |
| 5,467,542 | 11/1995 | Hulden | 37/468 |

*Primary Examiner*—Randolph A. Reese
*Assistant Examiner*—Thomas A. Beach
*Attorney, Agent, or Firm*—Lalos & Keegan

[57] ABSTRACT

An assembly for coupling an implement to an operating arm of a machine generally consisting of a first component fixedly mountable on the implement, having an annular gripping surface, and a second component connectable to the operating arm having a pair of gripping members displaceable along a first line of travel into and out of gripping engagement with the gripping surface of the first component, and am actuator for selectively displacing the gripping members into and out of such gripping engagement, the first component having at least one pair of spaced abutment surfaces disposed in opposed relation to the gripping members for restricting displacement of the gripping members relative to the first component along a second line of travel intersecting the first line of travel and at least one abutment surface engageable by the gripping members for restricting displacement of the gripping members along the first line of travel for retaining at least a portion of the gripping members in opposed relation to the pair of abutment surfaces whereby the implement would be free to be displaced angularly relative to the second coupling component about the axis of the gripping surface and prevented from being fully separated relative to the second coupling component substantially along the second line of travel when the gripping members are out of gripping engagement with the gripping surface.

27 Claims, 2 Drawing Sheets

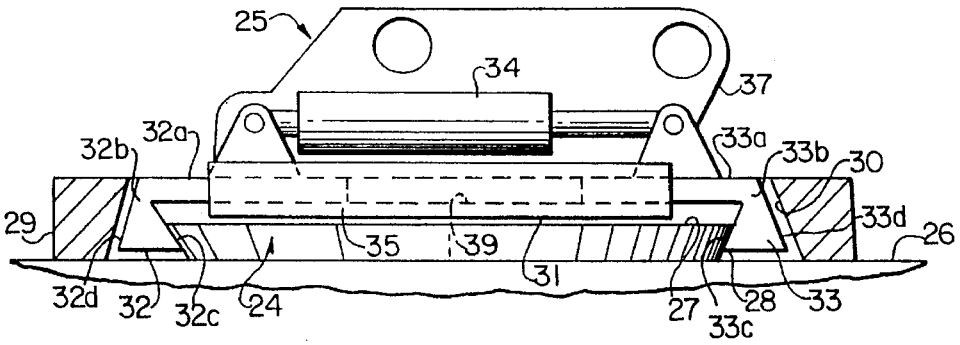
FIG. 5
FIG. 4
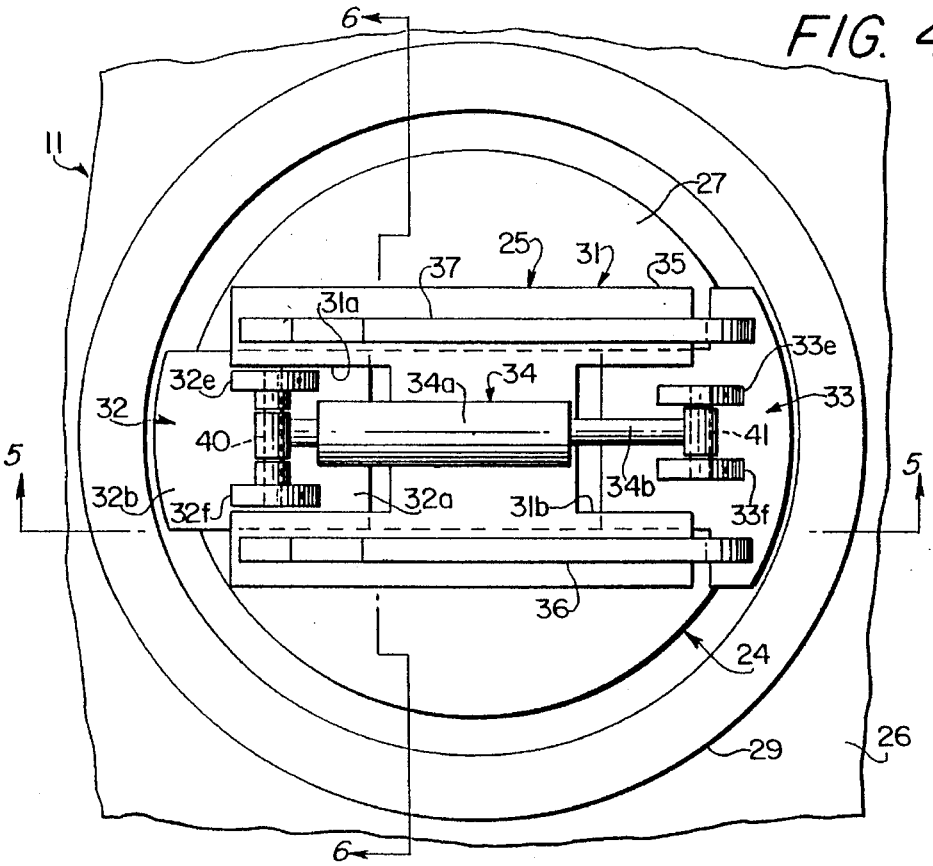
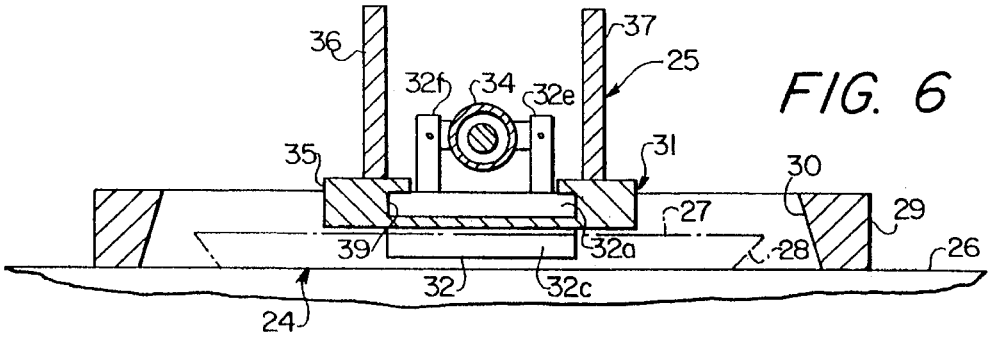
FIG. 6

IMPLEMENT COUPLING ASSEMBLY FOR EXCAVATOR MACHINES AND THE LIKE

This invention relates to an assembly for coupling an implement to an operating arm of an excavator machine and the like, and more particularly to such an assembly provided with means for selectively angularly displacing such an implement relative to the operating arm of the machine about a given axis.

There has been developed in the prior art a type of assembly for coupling an implement to the operating arm of a machine which generally consists of a first coupling component fixedly mounted on the working implement, and a second coupling component connectable to the operating arm of the machine and cooperable with the first coupling component to detachably secure the working implement to the operating arm. The first coupling component generally includes an annular, undercut portion providing a beveled gripping surface, and the second coupling component includes a pair of gripping members displaceable relative to each other, having arcuate, beveled gripping surfaces engageable with the beveled gripping surface of the first coupling component to firmly attach the working implement to the operating arm of the machine. Such type of coupling assembly is illustrated and more specifically described in U.S. Pat. No. 4,944,628 dated Jul. 31, 1990.

In the type of coupling assembly as described, the gripping members of the second coupling component may be operated to fully extend or retract into gripping relation with the gripping surface provided on the first coupling component and fully extended or retracted to displace the gripping members fully out of engagement with the first coupling component to permit the detachment of the first coupling component and implement from the second coupling component connected to the operating handle of the machine. Such arrangement permits the second coupling component either to be removed from the operating arm of the machine to permit the attachment of a conventional working implement or the attachment of the second coupling component to a first coupling component of a different working implement.

In circumstances in which the operator desires not to fully detach a working implement but merely to angularly displace the implement relative to the operating arm of the machine, the operator is able to operate the controls for the displacing means of the gripper members so that they may only partially extend or retract out of gripping engagement with the first coupler component, allowing the implement to be partially coupled to the second coupling component and thus permitting the operator to angularly displace the working implement relative to the operating arm of the machine. In partially uncoupling the working implement from the operating arm of the machine, the operator is required to exercise a certain amount of skill and be careful not to fully extend or retract the gripping members out of gripping engagement with the first coupling component mounted on the working implement in that the implement could become completely detached and fall and possibly cause injury to personnel in the area or damage to the implement or other property in the vicinity of the work area. It thus has been found to be desirable to provide a coupler assembly of the type described which will assure against the inadvertent detachment of the implement from the operating arm of the machine under circumstances where it is desired to merely partially uncouple the coupling components for the purpose of angularly displacing the working implement relative to the operating arm of the machine.

Accordingly, it is the principal object of the present invention to provide a novel assembly for coupling a working implement to the operating arm of a machine.

Another object of the present invention is to provide a novel assembly for coupling a working implement to the operating arm of a machine wherein the working implement may be angularly displaced relative to the operating arm about a given axis.

A further object of the present invention is to provide a novel assembly for coupling a working implement to the operating arm of a machine in which the working implement may be angularly displaced relative to the operating arm of the machine about a given axis without detaching the implement from the operating arm.

A still further object of the present invention is to provide a novel assembly for coupling a working implement to the operating arm of a machine in which the working implement may be partially uncoupled from the operating arm to permit the working implement to be angularly displaced relative to the operating arm about a given axis.

Another object of the present invention is to provide a novel assembly for coupling a working implement to the operating arm of a machine in which the working implement may be angularly displaced relative to the operating arm of a machine by either extending or retracting a set of gripping jaws out of gripping engagement with a gripping surface on the implement, provided with means assuring against a full extension of retraction of such gripping members causing an inadvertent detachment of the implement from the operating arm of the machine and possible attendant injury to personnel and/or damage to property.

A further object of the present invention is to provide a novel assembly for coupling a working implement to the operating arm of the machine in which the working implement may be angularly displaced relative to the operating arm about a given axis and which is comparatively simple in design, relatively inexpensive to manufacture and highly reliable in performance.

Other objects and advantages of the present invention will become more apparent to those persons having ordinary skill in the art to which the present invention pertains from the following description taken in conjunction with the accompanying drawings wherein:

FIG. 4 is an enlarged, top plan view of the implement shown in FIGS. 1 through 3, having a portion of the implement broken away and illustrating the coupling assembly disconnected from the operating arm of the machine;

FIG. 5 is a cross-sectional view taken along line 5—5 in FIG. 4; and FIG. 6 is a cross-sectional view taken along line 6—6 in FIG. 4.

Figure 1:
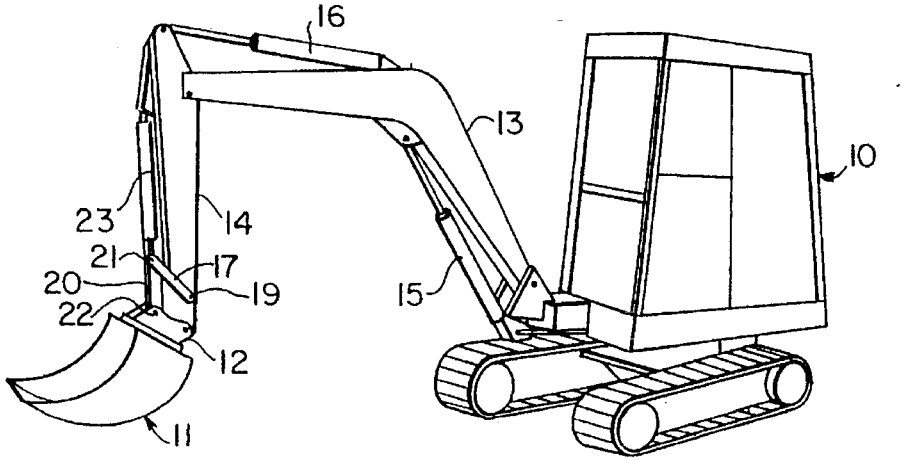
FIG. 1 is a perspective view of an excavating machine provided with a coupling assembly embodying the present invention.
Figure 2:
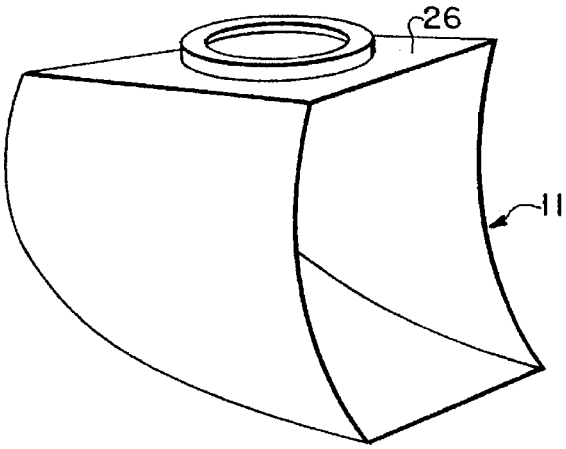
FIG. 2 is an enlarged perspective view of the implement shown attached to the machine illustrated in FIG. 1.
Figure 3:
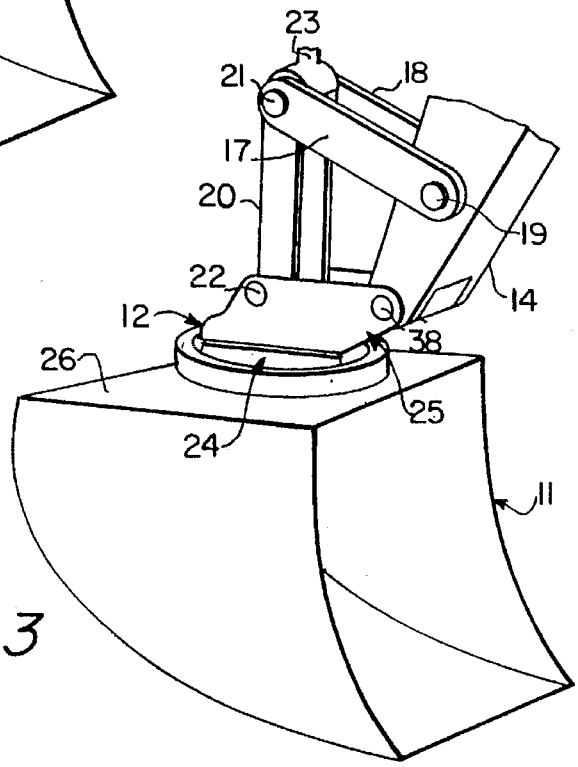
FIG. 3 is an enlarged perspective view of the machine shown in FIG. 1, having a portion thereof broken away and illustrating the working implement thereof angularly displaced approximately 180° relative to the position of the implement shown in FIG. 1.

Referring to FIGS. 1 through 3 of the drawings, there is illustrated an excavator machine 10, a bucket 11 and an assembly 12 for coupling the bucket to the excavating machine. The machine is provided with a conventional boom 13 pivotally connected to the front end of the main frame of the machine, an operating arm 14 pivotally connected to a free end of the boom, a hydraulic cylinder assembly 15 operatively interconnecting the main frame of the machine and an intermediate portion of the boom for pivoting the boom relative to the machine frame and a hydraulically actuated cylinder assembly 16 operatively interconnecting a mid-portion of the boom and an upper end of the operating arm. The lower end of the operating arm is provided with a pair of links 17 and 18 pivotally connected to the lower end of the operating arm by means of a connecting pin 19, and a link 20 pivotally connected at one end to the free ends of links 17 and 18 by means of pin 21, and pivotally connected at the opposite end thereof to the coupler assembly by means of connecting pin 22. The bucket is caused to be pivoted relative to the operating arm by means of a hydraulically actuated cylinder assembly 23 operatively interconnecting an upper end of the operating arm and connecting pin 21. By operating cylinder assemblies 15, 16 and 23 by the use of controls provided at an operator's station in the cab of the machine, bucket 11 or any other working implement such as a grapple, rake, stump splitter, rock or concrete crusher, jackhammer and the like, may be maneuvered to perform various work functions such as excavating, grappling, grading, raking, clearing, splitting, crushing, breaking and the like, in the conventional manner.

Referring to FIGS. 3 through 6 of the drawings, coupling assembly 12 consists of a coupling component 24 adapted to be fixedly secured to bucket 11, and a coupler component 25 adapted to be connected to the operating arm of the machine, cooperable with component 24 to selectively fully and partially attach the working implement to the operating arm of the machine. Coupler component 24 consists of a circularly configured member welded or otherwise fixedly secured to a wall portion 26 of the bucket, providing a circular upper surface 27 and an annular, beveled sidewall gripping surface 28. Also fixedly secured to upper wall 26 of the implement is an annular member 29 provided with an inwardly facing, annular beveled abutment surface 30 disposed in spaced, opposed relation to annular, beveled abutment surface 28 of coupler component 24, providing an annular recess or slot between such members having a cross-sectional configuration with divergent sides.

Coupler component 25 generally includes a carrier member 31 adapted to be seated on upper surface 27 of coupler component 24, a pair of gripping members 32 and 33 mounted on the carrier member, displaceable along the longitudinal centerline of the carrier member and cooperable with annular, beveled gripping surface 28 of coupler component 24, and a hydraulic cylinder assembly 34 mounted on the carrier member along the longitudinal centerline thereof and operatively connected to gripping members 32 and 33.

Carrier member 31 includes a substantially rectangular base plate section 35 and a pair of transversely spaced, longitudinally disposed bracket sections 36 and 37. As best shown in FIGS. 3 and 5, bracket sections 36 and 37 are provided with transversely aligned openings for receiving a connecting pin 38 for pivotally connecting the rear end of coupling component 25 to the lower end of operating arm 14, and connecting pin 22 for pivotally connecting the forwardly disposed end of coupling component 25 to link 20. As best shown in FIGS. 4 and 5, base plate section 35 is provided with a longitudinally disposed guide slot 39 in which gripping members 32 and 33 are mounted and displaceable along a line of travel disposed diametrically relative to the axis of annular, beveled surface 28 of coupler component 24.

Gripping members 32 and 33 are substantially similar in construction and function. As best shown in FIGS. 4 and 5, gripping member 32 includes a main body section **32*a* disposed and longitudinally displaceable in guide slot 39, and a head section 32*b* having a depending portion provided with an inwardly facing, annular beveled surface 32*c* engageable in gripping relation to annular, beveled gripping surface 28 of coupler component 24, and an outwardly facing, annular beveled abutment surface 32*d* engageable with annular, beveled abutment surface 30 of member 29 for restricting the radially, outwardly displacement of gripping member 32. The configurations and dimensions of coupling component 24, annular member 29 and gripping member 32 are selected so that when gripping member 32 is displaced radially outwardly to an intermediate position spaced from abutment surface 30, gripping surface 32*c* although not in gripping relation with gripping surface 28, will encounter the upper end of gripping surface 28 to restrict the displacement of the coupling components along a line of travel coinciding with the axis of coupler component 24, and correspondingly a separation of the implement from the operating arm of the machine. Gripping member 33 is disposed in diametrical alignment with gripping member 32 and similarly includes a main body section 33*a* displaceable within guide slot 39 and a depending section 33*b* provided with an inwardly facing, arcuate beveled surface 33*c* engageable with gripping surface 28 and an outwardly facing, arcuate beveled surface 33*d* engageable with abutment surface 30. The function of annular member 29 is to prevent an outward displacement of gripping members 32 and 33 causing the inwardly projecting portions thereof provided with arcuate beveled surfaces 32*c* and 33*c* from being withdrawn from the undercut portion of coupler component 24. Outer arcuate surfaces 32*d* and 33*d* of the gripping members will engage annular surface 30 of component 24** before such withdrawal occurs thus assuring that there will be no separation of the components and correspondingly of the implement from the operating arm of the machine.

As best shown in FIG. 4, gripping member 32 is provided with a set of transversely spaced brackets **32*e* and 32*f* which project upwardly through a recess 31*a* in one end of base plate section 31, and gripping member 33 is provided with a similar set of transversely spaced brackets 33*e* and 33*f* projecting upwardly through a recessed portion 31*b* in the opposite edge of base plate section 31. Gripping members 32 and 33 are adapted to be retracted into gripping engagement with annular beveled gripping surface 28 and extended into contact with beveled, annular abutment surface 30 by means of cylinder assembly 34 having a cylinder portion 34*a* pivotally connected to brackets 32*e* and 32*f* of gripping member 32 by means of pin 40, and a rod portion 34*b* connected to bracket portions 33*e* and 33*f* of gripping member 33 by means of a pin 41. It will be appreciated that by supplying fluid under pressure to the rod side of cylinder 34*a* the gripping members will be caused to retract into gripping engagement with coupler member 24, and when fluid under pressure is supplied to the base end of cylinder 34*a*, the gripping members will be caused to extend and engage abutment surface 30 of annular member 29**.

The components of the assembly as described can be of a fabricated or cast construction. In the manufacture of the assembly, with the individual components having been fabricated or cast, it is contemplated initially that coupling component or gripping plate member 24 be positioned and fixedly secured to upper wall 26 of the implement, preferably by welding. The gripping members are then inserted in guide slot 39 of carrier member 31, and the carrier member is positioned on gripping plate member 24 along a diameter of the gripping plate member with arcuate, beveled surfaces 32*c* and 33*c* of the gripping members disposed adjacent annular beveled surface 28 of the gripping plate member. Annular member 29 is then positioned on upper wall 26 of the implement, concentrically with respect to the gripping plate member, and fixedly secured to upper wall 26, preferably by welding. Component 29 also may be detachably secured to the upper wall of the implement to permit the detachment of component 25. Cylinder assembly 34 is then connected to the gripping members.

In connecting the coupler assembly to operating arm 14, the operating arm is maneuvered so that the lower end thereof is received between bracket sections 36 and 37 and the opening in the lower end of the operating arm is registered with the rearwardly disposed openings in bracket sections 36 and 37. Connecting pin 38 is then inserted in the registered openings to pivotally connect the rear end of coupler assembly to the operating arm. The opening in the lower end of connecting link 20 is then registered with the forwardly disposed openings in bracket sections 36 and 37 and connecting pin 22 is inserted in such registered openings to pivotally connect the implement to connecting link 20. Suitable hydraulic lines provided on the operating arm are then connected to the fluid ports of cylinder 34*a* to complete the assembly of the unit.

Once the assembly has been connected to the operating arm of the machine as described, the controls at the operator's station for the cylinder assembly may be operated to extend the rod portion of the cylinder assembly and correspondingly extend the gripping members out of engagement with gripping surface 28 of coupling component 24. The operating arm may then be maneuvered by means of other controls to position the implement at the desired angle relative to coupling component 25 and the operating arm, about the axis of the gripping plate. With the implement thus positioned, the controls for cylinder assembly 34 may then be operated to retract gripping members 32 and 33 into gripping engagement with gripping surface 28 to lock the position of the implement relative to the operating arm.

When it is desired to reposition the implement at a different angle relative to the operating arm, the suitable controls are operated to extend the gripping members out of gripping engagement with gripping surface 28 and the operating arm may be maneuvered to reposition the implement. In the course of repositioning the implement in such a manner, if the operating handle were to lift the implement off the ground, the implement would be prevented from detaching from the operating arm and falling by reason of the gripping members being prevented from extending sufficiently to clear arcuate surfaces 32*c* and 33*c* relative to gripping surface 28. In this regard, it will be noted that the gripping members are displaceable between fully coupled and partially coupled positions but not to a fully uncoupled position which would cause separation of coupling components 24 and 25 and corresponding detachment of the implement from the operating arm of the machine. Engagement of the gripping members with abutment surface 30 of annular member 29 assures that the lower, inwardly projection portions of the gripping members will always be disposed between beveled gripping surface 28 and upper wall 26 of the implement, restricting the displacement of such portions along lines of travel intersecting the line of travel of the griping members in retracting and extending into and out of fully coupling relation with coupling component 24.

Although the embodiment as described provides for the retraction of the gripping members into gripping engagement with the coupling component fixedly secured to the implement and the extension of the gripping members into the engagement of an abutment surface for preventing the extension of the gripping members into a fully uncoupled position, it is contemplated within the scope of the invention, an arrangement whereby the gripping members may be extended into a gripping relation with the coupling component fixedly secured to the implement and retracted to engage an abutment surface, positioning the gripping members in partially uncoupled positions and preventing them from displacing to a fully uncoupled position. It further is contemplated that other configurations may be employed, providing for the displacement of each gripping member along a first line of travel into engagement with a gripping surface and an abutment surface restricting the displacement of the gripping member in a direction away from the gripping surface, and a pair of spaced surfaces restricting the displacement of the gripping member along a second line of travel intersecting the first line of travel.

From the foregoing detailed description it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. An assembly for coupling an implement to an operating arm of a machine comprising:

a first component fixedly mountable on said implement, having an annular gripping surface;

a second component connectable to said operating arm having a pair of gripping members displaceable along a first line of travel into and out of gripping engagement with the gripping surface of said first component, and means for selectively displacing said gripping members into and out of said gripping engagement; and said first component having at least one pair of spaced, fixed abutment surfaces disposed in opposed relation to said gripping members for restricting displacement of said gripping members relative to said first component along a second line of travel intersecting said first line of travel, and at least one abutment surface engageable by said gripping members for restricting displacement of said gripping members along said first line of travel for retaining at least a portion of said gripping members in opposed relation to said pair of abutment surfaces, whereby said implement would be free to be displaced angularly relative to said second coupling component about the axis of said gripping surface and prevented from being fully separated relative to said second coupling component substantially along said second line of travel when said gripping members are out of gripping engagement with said gripping surface.

2. An assembly according to claim 1 wherein said displacing means comprises a fluid actuated means.

3. An assembly according to claim 1 wherein said displacing means comprises a hydraulic cylinder assembly.

4. An assembly according to claim 1 wherein said first line of travel is disposed substantially diametrically relative to said axis.

5. An assembly according to claim 1 wherein said second line of travel is disposed substantially parallel to said axis.

6. An assembly according to claim 1 wherein said gripping members are displaceable inwardly along said first line of travel into gripping relation with said gripping surface.

7. An assembly according to claim 1 wherein said gripping members are displaceable outwardly along said first line of travel into gripping relation with said gripping surface.

8. An assembly according to claim 1 wherein said gripping surface is beveled.

9. An assembly according to claim 8 wherein said gripping members include beveled surfaces engageable with said beveled gripping surface of said first component.

10. An assembly according to claim 1 wherein one of said abutment surfaces disposed in opposed relation to said gripping members for restricting displacement of said gripping members along said second line of travel comprises said gripping surface.

11. An assembly according to claim 1 wherein said abutment surface for restricting displacement of said gripping members along said first line of travel for retaining at least a portion of said gripping members in opposed relation to said pair of abutment surfaces, is annular.

12. An assembly for coupling an implement to an operating arm of a machine comprising:

a first component fixedly mountable on said implement having an annular recess, said annular recess having an annular gripping surface; and a second component connectable to said operating arm having a pair of gripping members each having a section received within said annular recess, provided with a surface displaceable along a first line of travel into and out of gripping engagement with the gripping surface of said first component, in gripping relation, said annular recess having a pair of spaced, fixed abutment surfaces disposed in opposed relation to said gripping member sections for restricting displacement of said gripping members relative to said first component along a second line of travel intersecting said first line of travel, and an annular abutment surface for restricting displacement of said gripping members along said first line of travel for retaining at least a portion of each of said gripping member sections in opposed relation to said pair of abutment surfaces whereby said implement would be free to be displaced angularly relative to said second coupling component about the axis of said gripping surface of said first coupling component and prevented from being fully separated from said second coupling component when said gripping member sections are out of gripping engagement with said gripping surface of said first coupler component.

13. An assembly according to claim 12 wherein said displacing means comprises a fluid actuated means.

14. An assembly according to claim 12 wherein said displacing means comprises a hydraulic cylinder assembly.

15. An assembly according to claim 12 wherein said first line of travel is disposed substantially diametrically relative to said axis.

16. An assembly according to claim 12 wherein said second line of travel is disposed substantially parallel to said axis.

17. An assembly according to claim 12 wherein said gripping members are displaceable inwardly along said first line of travel into gripping relation with said gripping surface.

18. An assembly according to claim 12 wherein said gripping members are displaceable outwardly along said first line of travel into gripping relation with said gripping surface.

19. An assembly according to claim 12 wherein said gripping surface is beveled.

20. An assembly according to claim 19 wherein said gripping members include beveled surfaces engageable with said beveled gripping surface of said first component.

21. An assembly according to claim 12 wherein said annular recess includes an undercut portion providing said abutment surface for restricting displacement of said gripping members relative to said first component along said first line of travel.

22. An assembly according to claim 21 wherein each of said gripping members includes a portion projecting into said undercut portion of said annular recess.

23. An assembly according to claim 22 wherein said gripping surface of said first coupling component is beveled.

24. An assembly according to claim 23 wherein said beveled gripping surface comprises one of said spaced abutment surfaces.

25. An assembly according to claim 24 wherein said projecting portions of said gripping member section are provided with arcuate, beveled surfaces.

26. An assembly according to claim 12 wherein said annular recess has a cross-sectional configuration provided with diverting sides, and each of said gripping member sections has a cross-sectional configuration provided with diverting sides.

27. An assembly connectable to an operating arm of a machine for performing a work function comprising:

an implement having an annular gripping surface;

a coupling component connectable to said operating arm having a pair of gripping members displaceable along a first line of travel into and out of gripping engagement with the gripping surface of said implement and means for selectively displacing said gripping members into and out of said gripping engagement; and said implement having at least one pair of spaced, fixed abutment surfaces engageable by said gripping members for restricting displacement of said gripping members relative to said coupling component along a second line of travel intersecting said first line of travel, and at least one abutment surface engageable by said gripping members for restricting displacement of said gripping members along said first line of travel for retaining at least a portion of said gripping members in opposed relation to said pair of abutment surfaces whereby said implement would be free to be displaced angularly relative to said coupling component about the axis of said gripping surface and prevented from being fully separated relative to the coupling component substantially along said second line of travel when the gripping members are out of gripping engagement with said gripping surface.

* * * * *